US008177857B2

(12) United States Patent
Creamer et al.

(10) Patent No.: US 8,177,857 B2
(45) Date of Patent: May 15, 2012

(54) LAUNDRY COMPOSITIONS CONTAINING AN AMPHOLYTIC POLYMER AND THEIR USE

(75) Inventors: Marianne Patricia Creamer, Warrington, PA (US); Joseph Manna, Quakertown, PA (US); Jan Edward Shulman, Newtown, PA (US)

(73) Assignee: Rohm and Haas Company, Philadelphia, PA (US)

( * ) Notice: Subject to any disclaimer, the term of this patent is extended or adjusted under 35 U.S.C. 154(b) by 1341 days.

(21) Appl. No.: 11/366,133

(22) Filed: Mar. 2, 2006

(65) Prior Publication Data

US 2006/0199756 A1 Sep. 7, 2006

Related U.S. Application Data

(60) Provisional application No. 60/658,784, filed on Mar. 4, 2005.

(51) Int. Cl.

| | |
|---|---|
| ***B08B 3/04*** | (2006.01) |
| ***C11D 3/37*** | (2006.01) |
| ***C11D 1/02*** | (2006.01) |
| ***C11D 1/38*** | (2006.01) |

(52) U.S. Cl. ..... 8/137; 510/327; 510/340; 510/350; 510/356; 510/357; 510/394; 510/426; 510/433; 510/475; 510/492; 510/499; 510/515

(58) Field of Classification Search ..... 510/327, 510/340, 350, 356, 357, 394, 426, 433, 475, 510/492, 499, 515; 8/137
See application file for complete search history.

(56) References Cited

U.S. PATENT DOCUMENTS

| | | | | |
|---|---|---|---|---|
| 5,686,024 | A | 11/1997 | Dahanayake et al. | |
| 2002/0052304 | A1 * | 5/2002 | Aubay et al. | 510/361 |
| 2003/0134770 | A1 | 7/2003 | Sivik et al. | |
| 2004/0152617 | A1 | 8/2004 | Murphy | |

FOREIGN PATENT DOCUMENTS

| | | |
|---|---|---|
| DE | 10141006 | 3/2003 |
| EP | 0112592 | 7/1984 |
| EP | 0560519 | 9/1993 |
| GB | 2104091 | 3/1983 |
| JP | 59135293 | 1/1993 |
| JP | 2001131590 | 5/2001 |
| JP | 2002060788 | 2/2002 |
| JP | 2002060790 | 2/2002 |

* cited by examiner

*Primary Examiner* — Brian P Mruk
(74) *Attorney, Agent, or Firm* — Carl P. Hemenway

(57) ABSTRACT

There is provided a laundry composition comprising i) at least one laundry component selected from the group consisting of surfactants, softening agents, and mixtures thereof and ii) at least one ampholytic polymer comprising, as polymerized units, a) 20% to 90% by weight, based on the solid weight of said ampholytic polymer, at least one cationic monomer, b) 10% to 70% by weight, based on the solid weight of said ampholytic polymer, at least one anionic monomer, and c) 0% to 90% by weight, based on the solid weight of said ampholytic polymer, at least one nonionic monomer;

wherein the equivalent ratio of said monomer a) to said monomer b) is from 0.33:1 to 1.2:1; and wherein said ampholytic polymer has weight-average molecular weight of 50,000 or less. Further provided is a method of laundering textiles comprising treating said textiles with such laundry compositions.

8 Claims, No Drawings

LAUNDRY COMPOSITIONS CONTAINING AN AMPHOLYTIC POLYMER AND THEIR USE

This non-provisional application claims priority to prior U.S. provisional Application Ser. No. 60/658,784 filed on Mar. 4, 2005.

BACKGROUND

Compositions that are useful for cleaning various substrates often contain a wide variety of ingredients. U.S. Pat. No. 5,609,862 discloses compositions for cleaning hair that include polymer and anionic surfactant, among other ingredients. It is desired to provide laundry compositions that contain at least one polymer and at least one further ingredient such as at least one surfactant, at least one softening agent, or some mixture thereof. It is known in the art that certain ingredients are incompatible with each other; that is, combinations of those ingredients, when included in a laundry composition, cause some properties of the laundry composition (such as, for example, clarity, cleaning effectiveness, effectiveness at inhibiting clay soil redeposition, softening effectiveness, other properties, or combinations thereof) to become less desirable. It is desired to provide laundry compositions that are robust; that is, laundry compositions that can be formulated with combinations of some ordinarily incompatible ingredients without significant loss of desirable properties. For example, some of such desirable laundry compositions include both cationic softening agent and anionic surfactant; in the past, such compositions were not effective both at cleaning and at softening; it is desired to provide such laundry compositions that are effective at cleaning (in particular, at inhibiting clay soil redeposition) and at softening. For another example, some of such desirable laundry compositions include both cationic softening agent and anionic surfactant; in the past, such compositions exhibited turbidity or phase separation; it is also desired to provide such laundry compositions that do not phase separate and that have low turbidity. For yet another example, it is desired to provide laundry compositions that include at least one anionic surfactant, that may or may not also include a softening agent, and that provide better inhibition of clay soil redeposition than that provided by previously-known laundry compositions.

STATEMENT OF THE INVENTION

In a first aspect of the present invention, there is provided a laundry composition comprising i) at least one laundry component selected from the group consisting of surfactants, softening agents, and mixtures thereof and ii) at least one ampholytic polymer comprising, as polymerized units, a) 20% to 90% by weight, based on the solid weight of said ampholytic polymer, at least one cationic monomer, b) 10% to 70% by weight, based on the solid weight of said ampholytic polymer, at least one anionic monomer, and c) 0% to 90% by weight, based on the solid weight of said ampholytic polymer, at least one nonionic monomer;

wherein the equivalent ratio of said monomer a) to said monomer b) is from 0.33:1 to 1.2:1; and wherein said ampholytic polymer has weight-average molecular weight of 50,000 or less.

In a second aspect of the present invention, there is provided a method of laundering textiles comprising treating said textiles with a laundry composition comprising:

i) at least one laundry component selected from the group consisting of surfactants, softening agents, and mixtures thereof and ii) at least one ampholytic polymer comprising, as polymerized units, a) 20% to 90% by weight, based on the solid weight of said ampholytic polymer, at least one cationic monomer, b) 10% to 70% by weight, based on the solid weight of said ampholytic polymer, at least one anionic monomer, and c) 0% to 90% by weight, based on the solid weight of said ampholytic polymer, at least one nonionic monomer;

wherein the equivalent ratio of said monomer a) to said monomer b) is from 0.33:1 to 1.2:1; and wherein said ampholytic polymer has weight-average molecular weight of 50,000 or less.

In a third aspect of the present invention, there is provided a laundry composition comprising:

i) at least one laundry component selected from the group consisting of surfactants, softening agents, and mixtures thereof and ii) at least one ampholytic polymer comprising, as polymerized units, a) 20% to 90% by weight, based on the solid weight of said ampholytic polymer, at least one cationic monomer that is not a (meth)acrylamidoalkytrialkylammonium quaternary monomer, b) 10% to 70% by weight, based on the solid weight of said ampholytic polymer, at least one anionic monomer, and c) 0% to 90% by weight, based on the solid weight of said ampholytic polymer, at least one nonionic monomer;

wherein the equivalent ratio of said monomer a) to said monomer b) is from 0.33:1 to 1.2:1; and wherein said ampholytic polymer has weight-average molecular weight of 50,000 or less.

In a fourth aspect of the present invention, there is provided a method of laundering textiles comprising treating said textiles with a laundry composition comprising:

i) at least one laundry component selected from the group consisting of surfactants, softening agents, and mixtures thereof and ii) at least one ampholytic polymer comprising, as polymerized units, a) 20% to 90% by weight, based on the solid weight of said ampholytic polymer, at least one cationic monomer that is not a (meth)acrylamidoalkytrialkylammonium quaternary monomer, b) 10% to 70% by weight, based on the solid weight of said ampholytic polymer, at least one anionic monomer, and c) 0% to 90% by weight, based on the solid weight of said ampholytic polymer, at least one nonionic monomer;

wherein the equivalent ratio of said monomer a) to said monomer b) is from 0.33:1 to 1.2:1; and wherein said ampholytic polymer has weight-average molecular weight of 50,000 or less.

DETAILED DESCRIPTION

The practice of the present invention involves the use of laundry compositions. "Laundry," as used herein, refers to the operation of cleaning fabric and to operations that are normally done in connection with cleaning fabric, such as, for example, soaking, pre-treating, softening, rinsing, drying, and combinations thereof. "Laundry compositions," as used herein, refers to compositions suitable for use in one or more laundry operations. As used herein, "treating" fabric with a laundry composition will mean performing any laundry operation or combination of laundry operations that involves contacting that laundry composition with that fabric.

As used herein, the prefix "(meth)acryl-" means "methacryl- or acryl-."

As used herein, a ratio that is described as "X: 1 or higher" means any ratio of Y: 1, as long as Y has any value equal to X or larger than X. Similarly, as used herein, a ratio that is described as "X:1 or lower" means any ratio of Z:1, as long as Z has any value equal to X or smaller than X.

It is to be understood that for purposes of the present specification and claims that the range and ratio limits recited herein can be combined. For example, if ranges of 60 to 120 and 80 to 110 are recited for a particular parameter, it is understood that the ranges of 60 to 110 and 80 to 120 are also contemplated. As a further, independent, example, if a particular parameter is disclosed to have suitable minima of 1, 2, and 3, and if that parameter is disclosed to have suitable maxima of 9 and 10, then all the following ranges are contemplated: 1 to 9, 1 to 10, 2 to 9, 2 to 10, 3 to 9, and 3 to 10.

Herein, the amount of an ingredient included in the laundry composition of the present invention is sometimes characterized by "solids weight percent." As used herein, the "solids" of a material are all the matter that remains un-evaporated after a 1 mm thick layer of that material has been exposed to a non-enclosed atmosphere at 1 atmosphere pressure at 150° C. for 1 hour. The "solids weight percent" of an ingredient in the laundry composition of the present invention is the ratio of the solids weight of that ingredient to the solids weight of the entire laundry composition, expressed as a percentage.

Some embodiments of the present invention involve the use of one or more surfactant. Surfactants are compounds, the molecules of which contain both at least one hydrophilic group and at least one hydrophobic group. Suitable hydrophobic groups usually include a hydrocarbon chain with 6 or more carbon atoms, or 9 or more carbon atoms, or 10 or more carbon atoms. Some suitable hydrophobic groups are, for example, alkyl groups, alkenyl groups, alkylaryl groups, versions thereof with one or more substituent, versions thereof with one or more ester linkage, versions thereof with one or more ether linkage, versions thereof with one or more amide linkage, combinations thereof, and mixtures thereof. Some suitable surfactants, are, for example, anionic surfactants, cationic surfactants, nonionic surfactants, amphoteric surfactants, and mixtures thereof.

Suitable anionic surfactants include, for example, carboxylate surfactants, N-acyl sarcosinate surfactants, acylated protein hydrolysate surfactants, sulfonate surfactants, sulfate surfactants, and phosphate ester surfactants. Suitable carboxylate surfactants include, for example, alkyl carboxylates, alkenyl carboxylates, and polyalkoxy carboxylates. Suitable sulfonate surfactants include, for example, alkyl sulfonates, aryl sulfonates, and alkylaryl sulfonates. Some examples of suitable sulfonate surfactants are alkylbenzene sulfonates, naphthalene sulfonates, alpha-olefin sulfonates, petroleum sulfonates, and sulfonates in which the hydrophobic group includes at least one linkage that is selected from ester linkages, amide linkages, ether linkages (such as, for example, dialkyl sulfosuccinates, amido sulfonates, sulfoalkyl esters of fatty acids, and fatty acid ester sulfonates), and combinations thereof. Some suitable sulfate surfactants include, for example, alcohol sulfate surfactants, ethoxylated and sulfated alkyl alcohol surfactants, ethoxylated and sulfated alkyl phenol surfactants, sulfated carboxylic acids, sulfated amines, sulfated esters, and sulfated natural oils or fats. Some suitable phosphate ester surfactants are, for example phosphate monoesters and phosphate diesters.

Suitable anionic surfactants have corresponding cations. Suitable corresponding cations include, for example, sodium, potassium, ammonium, monoethanolamine, diethanolamine, triethanolamine, magnesium cations, and mixtures thereof.

Mixtures of suitable anionic surfactants are also suitable.

Among embodiments in which one or more anionic surfactant is used, in some of such embodiments, the laundry composition of the present invention includes anionic surfactant in the amount, by solids weight percent based on the solids weight of the laundry composition, of 5% or more; or 10% or more; or 20% or more; or 30% or more; or 40% or more. Independently, when a cationic surfactant is used, in some embodiments the amount of anionic surfactant, by solids weight percent based on the solids weight of the laundry composition, is 70% or less; 60% or less; or 50% or less.

Suitable cationic surfactants include, for example, amine surfactants and quaternary ammonium salt surfactants. Suitable amine surfactants include, for example, primary, secondary, and tertiary alkyl amine surfactants; primary, secondary, and tertiary alkenyl amine surfactants; imidazoline surfactants; amine oxide surfactants; ethoxylated alkylamine surfactants; surfactants that are alkoxylates of ethylene diamine; and amine surfactants where the hydrophobic group contains at least one amide linkage. Suitable quaternary ammonium salt surfactants include, for example, dialkyldimethylammonium salt surfactants, alkylbenzyldimethylammonium salt surfactants, alkyltrimethylammonium salt surfactants, alkylpyridinium halide surfactants, surfactants made by quaternizing tertiary amine compounds, and esterquats (i.e., surfactants that are quaternary ammonium salts with at least one hydrophobic group that contains an ester linkage).

Suitable quaternary ammonium salt surfactants have corresponding anions. Suitable corresponding anions include, for example, halide ions (such as, for example, chloride ions), methyl sulfate ions, other anions, and mixtures thereof.

Mixtures of suitable cationic surfactants are also suitable.

Among embodiments in which one or more cationic surfactant is used, in some of such embodiments, the laundry composition of the present invention includes cationic surfactant in the amount, by solids weight percent based on the solids weight of the laundry composition, of 0.1% or more; or 0.5% or more; or 1% or more; or 2% or more. Independently, when a cationic surfactant is used, in some embodiments the amount of cationic surfactant, by solids weight percent based on the solids weight of the laundry composition, is 25% or less; or 10% or less; 7% or less; or 5% or less.

Suitable nonionic surfactants include, for example, polyoxyethylene surfactants; surfactants that are esters of carboxylic acids; surfactants that are ethoxylated natural oils, fats, or waxes; carboxylic amide surfactants; and polyoxyalkylene block copolymer surfactants. Suitable polyoxyethylene surfactants include, for example, alcohol ethoxylate surfactants and alkylphenol ethoxylates. Suitable carboxylic acid ester surfactants include, for example, glycerol ester surfactants, surfactants that are esters of glycols (such as, for example, ethylene glycol, diethylene glycol, and 1,2-propane diol), polyethylene glycol ester surfactants, anhydrosorbitol ester surfactants, and ethoxylated anhydrosorbitol ester surfactants. Suitable carboxylic amide surfactants include, for example, diethanolamide surfactants, monoalkanolamide surfactants, and polyoxyethylene amide surfactants. Suitable polyoxyalkylene block copolymer surfactants include, for example, poly(oxyethylene-co-oxypropylene) surfactants. Mixtures of suitable nonionic surfactants are also suitable.

Among embodiments in which one or more nonionic surfactant is used, in some of such embodiments, the laundry composition of the present invention includes nonionic surfactant in the amount, by solids weight percent based on the solids weight of the laundry composition, of 1% or more; or 2% or more; or 5% or more; or 10% or more. Independently, when a nonionic surfactant is used, in some embodiments the amount of nonionic surfactant, by solids weight percent based on the solids weight of the laundry composition, is 50% or less; 40% or less; or 30% or less.

Amphoteric surfactants include, for example, alkylbetaine surfactants, amidopropylbetaine surfactants, and surfactants that are derivatives of imidazolinium. Mixtures of suitable amphoteric surfactants are also suitable.

The practice of the present invention involves the use of at least one softening agent. Softening agents are compounds that, when used for treating fabric, are capable of imparting one or more of the following features to the fabric: a more pleasant feel to the touch after the laundry process is complete; reduced surface friction after the laundry process is complete; lower tendency of the fabric to acquire (for example, during drying in an automatic dryer) a static electrical charge; and a combination thereof. Some suitable softening agents are the quaternary ammonium salt surfactants described herein above. Some quaternary ammonium salt surfactants that are useful as softening agents are, for example, dialkyldimethylammonium salt surfactants and esterquats.

Another category of suitable softening agents is a blend of an anionic surfactant with a water-soluble cationic polymer. Some of such blends are described in US Patent Application Publication 2004/0152617. Such softening agents are blends of anionic surfactant with water-soluble cationic polymer; the water-soluble cationic polymer included in such blends has at least one cationic monomer as a polymerized unit and has a net cationic charge at one or more points over the pH range of 6 to 11.

When a cationic surfactant is used as a softening agent, the amount of that softening agent can be characterized as the solids weight percent of that softening agent. When a softening agent is used that is a blend of a cationic polymer and an anionic surfactant, the amount of softening agent is characterized herein by the solids weight percent of the cationic polymer alone. When a mixture of softening agents is used, the solids weight percent of softening agent is the sum of the solids weight percents of all of the individual solids weight percents of each softening agent.

Among embodiments in which the laundry composition of the present invention contains one or more softening agents, in some of such embodiments the amount of softening agent, by solids weight percent, based on the solids weight of the laundry composition of 0.1% or more; 0.2% or more; or 0.4% or more; or 0.6% or more. Independently, some of the laundry compositions in such embodiments contain softening agent in the amount, by solids weight percent, based on the solids weight of the laundry composition of 25% or less; or 15% or less; or 8% or less; 4% or less; or 2% or less.

Mixtures of suitable softening agents are also suitable.

A "polymer," as used herein and as defined by F W Billmeyer, JR. in *Textbook of Polymer Science*, second edition, 1971, is a relatively large molecule made up of the reaction products of smaller chemical repeat units. Normally, polymers have 11 or more repeat units. Polymers may have structures that are linear, branched, star shaped, looped, hyperbranched, crosslinked, or a combination thereof; polymers may have a single type of repeat unit ("homopolymers") or they may have more than one type of repeat unit ("copolymers"). Copolymers may have the various types of repeat units arranged randomly, in sequence, in blocks, in other arrangements, or in any mixture or combination thereof. Chemicals that react with each other to form the repeat units of a polymer are known herein as "monomers," and a polymer is said herein to be made of "polymerized units" of the monomers that reacted to form the repeat units. The chemical reaction or reactions in which monomers react to become polymerized units of a polymer are known herein as "polymerizing" or "polymerization."

Polymer molecular weights can be measured by standard methods such as, for example, size exclusion chromatography or intrinsic viscosity. Generally, polymers have weight-average molecular weight (Mw) of 1,000 or more.

The practice of the present invention involves the use of at least one cationic monomer. Cationic monomers are compounds that form polymerized units in which at least one cation is covalently attached to the polymer. The anion or anions corresponding to the covalently-attached cation or cations may be in solution, in a complex with the cation, located elsewhere on the polymer, or a combination thereof. In some embodiments, one or more cationic monomers are used that contain a cation that exists in cationic form when residing in water at some range of pH values useful for laundry operations, while that cation may be in neutral form at some other pH values. In some embodiments, at least one cationic monomer is used that is in neutral form during polymerization; in such embodiments, after polymerization (before or during a laundry process), conditions surrounding the polymer (such as, for example, pH) are altered so that the polymerized unit resulting from that cationic monomer acquires a positive charge. Independently, in some embodiments, one or more cationic monomers are used that contain a cation that is permanently in cationic form, such as, for example, a quaternary ammonium salt.

The anion corresponding to the cation of a suitable cationic monomer may be any type of anion. Some suitable anions are, for example, halides (including, for example, chloride, bromide, or iodide), hydroxide, phosphate, sulfate, hydrosulfate, ethyl sulfate, methyl sulfate, formate, acetate, or any mixture thereof.

Quaternary ammonium salt compounds that are suitable as cationic monomers include, for example, (meth)acrylamidoalkyltrialkylammonim quaternary compounds, diallyldialkylammonium quaternary compounds, and mixtures thereof.

(Meth)acrylamidoalkyltrialkylammonim quaternary compounds have the structure

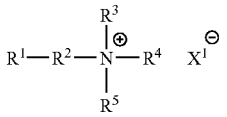

where $R^1$ is a (meth)acrylamido group, which has the structure

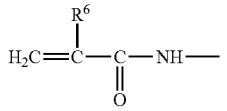

where $R^6$ is either hydrogen or a methyl group; $R^2$ is a bivalent alkyl group; each of $R^3$, $R^4$, and $R^5$ is, independently, a methyl or ethyl group; and $X^{1\ominus}$ is an anion, for example any of the anions discussed herein above as suitable anions corresponding to cations of suitable cationic monomers. In some embodiments, $R^6$ is hydrogen. Independently, in some embodiments, $R^2$ is n-propyl (i.e., $R^2$ is —$CH_2$—$CH_2$—$CH_2$—). Independently, in some embodiments, one, two, or all three of $R^3$, $R^4$, and $R^5$ are methyl groups. Independently, in some embodiments, $X^{1\ominus}$ is a chloride ion.

Diallyldialkylammonium quaternary compounds have the structure

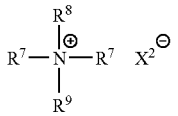

where each $R^7$ is an allyl group; each of $R^8$ and $R^9$ is, independently, an alkyl group with 1 to 3 carbon atoms; and $X^{2\ominus}$ is an anion, for example any of the anions discussed herein above as suitable anions corresponding to cations of suitable cationic monomers. In some embodiments, each of $R^8$ and $R^9$ is a methyl group. Independently, in some embodiments, $X^{2\ominus}$ is a chloride ion.

Under many common polymerization conditions, a diallyldialkyammonium quaternary monomer forms a polymerized units that is a 5-membered ring.

Further examples of suitable cationic monomers are aminoalkyl esters of (meth)acrylic acid, which have the structure

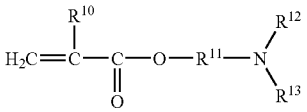

where $R^{10}$ is hydrogen or a methyl group, $R^{11}$ is a bivalent alkyl group, and $R^{12}$ and $R^{13}$ is each independently either a hydrogen, a methyl group, or an ethyl group. In some embodiments, $R^{10}$ is a methyl group. Independently, in some embodiments, $R^{11}$ is either an ethyl group or a propyl group. Independently, in some embodiments, $R^{12}$ and $R^{13}$ are both methyl groups. Suitable cationic monomers that are aminoalkyl esters of (meth)acrylic acid include, for example, 2-(dimethylamino)ethyl methacrylate, 2-(dimethylamino) ethyl acrylate, and 3-dimethylaminopropyl.

Mixtures of suitable cationic monomers are also suitable.

In some embodiments, the laundry composition of the present invention includes at least one ampholytic polymer that has no polymerized units of any (meth)acrylamidoalkyltrialkylammonim quaternary monomer. In some embodiments, every ampholytic polymer included in the laundry composition of the present invention is an ampholytic polymer that has no polymerized units of any (meth)acrylamidoalkyltrialkylammonim quaternary monomer.

Independently, in some embodiments, the laundry composition of the present invention includes at least one ampholytic polymer that has no polymerized units of any diallyldialkylammonium quaternary monomer. In some embodiments, every ampholytic polymer included in the laundry composition of the present invention is an ampholytic polymer that has no polymerized units of any diallyldialkylammonium quaternary monomer.

Independently, in some embodiments, the laundry composition of the present invention includes at least one ampholytic polymer that has no polymerized units of any monomer that is an aminoalkyl ester of (meth)acrylic acid. In some embodiments, every ampholytic polymer included in the laundry composition of the present invention is an ampholytic polymer that has no polymerized units of any monomer that is an aminoalkyl ester of (meth)acrylic acid.

The amount of cationic monomer used in an ampholytic polymer of the present invention is such that the polymerized units of cationic monomer are 20% to 90% by weight, based on the solid weight of said ampholytic polymer.

The practice of the present invention involves the use of at least one anionic monomer. Anionic monomers are compounds that form polymerized units in which at least one anion is covalently attached to the polymer backbone. The cation or cations corresponding to the covalently-attached anion or anions may be in solution, in a complex with the anion, located elsewhere on the polymer, or a combination thereof. In some embodiments, one or more anionic monomers are used that contain an anion that exists in anionic form when residing in water at some range of pH values useful for laundry operations, while that anion may be in neutral form at some other pH values. In some embodiments, at least one anionic monomer is used that is in neutral form during polymerization; in such embodiments, after polymerization (before or during a laundry process), conditions surrounding the polymer (such as, for example, pH) are altered so that the polymerized unit resulting from that anionic monomer acquires a negative charge.

Some suitable anionic monomers are, for example, ethylenically unsaturated acid monomers, including, for example, ethylenically unsaturated carboxylic acid monomers, maleic monomers, and ethylenically unsaturated sulfonic acid monomers. Suitable unsaturated carboxylic acid monomers include, for example, acrylic acid, methacrylic acid, and mixtures thereof. Suitable maleic monomers include, for example, maleic acid, maleic anhydride, and substituted versions thereof. Suitable unsaturated sulfonic acid monomers include, for example, 2-(meth)acrylamido-2-methylpropanesulfonic acid.

The amount of anionic monomer used in an ampholytic polymer of the present invention is such that the polymerized units of anionic monomer are 10% to 70% by weight, based on the solid weight of said ampholytic polymer.

The ampholytic polymer of the present invention contains at least one polymerized unit formed from a cationic monomer. In some embodiments, the ampholytic polymer contains plural polymerized units formed from plural identical cationic monomer molecules. In some embodiments, the ampholytic polymer contains plural polymerized units formed from one or more of each of two or more non-identical cationic monomer molecules.

The ampholytic polymer of the present invention contains at least one polymerized unit formed from a anionic monomer. In some embodiments, the ampholytic polymer contains plural polymerized units formed from plural identical anionic monomer molecules. In some embodiments, the ampholytic polymer contains plural polymerized units formed from one or more of each of two or more non-identical anionic monomer molecules.

In some embodiments, the ampholytic polymer contains no polymerized units from any monomer that is neither a cationic monomer nor an anionic monomer. In some embodiments, the ampholytic polymer contains at least one polymerized unit from a nonionic monomer (i.e., a monomer that is neither a cationic monomer nor an anionic monomer). Some suitable nonionic monomers are, for example, ethylenically unsaturated nonionic compounds, including compounds with one double bond, two double bonds, or more double bonds. Suitable ethylenically unsaturated nonionic monomers include, for example, olefins, substituted olefins (including, for example, vinyl halides and vinyl carboxylates), dienes, (meth)acrylates, substituted (meth)acrylates, (meth)acrylamide, substituted (meth)acrylamides, styrene, substituted styrenes, and mixtures thereof. As used herein "(meth)acrylates" are esters of acrylic acid and methacrylic acid; and "substituted" means any substituent group, including, for example, halogens, hydroxyl groups, alkyl groups, vinyl groups, (meth)acrylic groups, glycidyl groups, hydroxyalkyl groups, alkylene oxide groups, polyalkylene oxide groups, and combinations thereof. In some embodiments, one or more nonionic monomers are used that are selected from the group of (meth)acrylate esters, substituted (meth)acrylate esters, (meth)acrylamide, substituted (meth)acrylamide, and mixtures thereof. In some embodiments, acrylamide or methacrylamide or a mixture thereof is used.

Among embodiments in which at least one ampholytic polymer of the present invention contains polymerized units of nonionic monomer, such ampholytic polymers contain, as polymerized units, nonionic monomer in the amount, by weight, based on the weight of the ampholytic polymer, of 90% or less; or 70% or less; or 50% or less; or 30% or less. Among embodiments in which at least one ampholytic polymer of the present invention contains polymerized units of nonionic monomer, such ampholytic polymers contain, as polymerized units, nonionic monomer in the amount, by weight, based on the weight of the ampholytic polymer, of 0.1% or more; or 1% or more; or 5% or more; or 10% or more; or 20% or more. In some embodiments, the laundry composition of the present invention contains at least one ampholytic polymer that contains no polymerized units of nonionic monomer.

In some embodiments, the laundry composition of the present invention contains at least one ampholytic polymer that contains one or more polymerized units from crosslinking monomer. A crosslinking monomer is a monomer that has two functional groups capable of participating in a polymerization reaction. Some crosslinking monomers, for example, have two or more ethylenically unsaturated groups. Some crosslinking monomers, for example, have at least one ethylenically unsaturated group and at least one other group (such as, for example, a glycidyl group) capable of participating in a polymerization reaction. In some embodiments, the laundry composition of the present invention contains at least one ampholytic polymer that contains no polymerized units from crosslinking monomer.

In some embodiments, the laundry composition of the present invention contains at least one ampholytic polymer that contains one or more polymerized units from one or more alkyl esters of (meth)acrylic acid where the alkyl group has 4 or more carbon atoms. In some embodiments, the laundry composition of the present invention contains at least one ampholytic polymer that contains no polymerized units from alkyl esters of (meth)acrylic acid where the alkyl group has 4 or more carbon atoms. In some embodiments, the laundry composition of the present invention contains at least one ampholytic polymer that contains no polymerized units from alkyl esters of (meth)acrylic acid.

In some embodiments, the laundry composition of the present invention contains at least one ampholytic polymer that contains one or more polymerized units from one or more esters of (meth)acrylic acid where the ester group contains at least one alkylene oxide group. Such ester groups may contain one or more single alkylene oxide groups, one or more polyoxyethylene groups, or a combination thereof. In some embodiments, the laundry composition of the present invention contains at least one ampholytic polymer that contains no polymerized units from esters of (meth)acrylic acid where the ester group contains at least one alkylene oxide group.

One useful way to characterize an ampholytic polymer of the present invention is the equivalent ratio of polymerized units from all cationic monomers to polymerized units from all anionic monomers. The equivalent value of a polymerized unit from a cationic monomer is the number of cations that are covalently bound to the polymer molecule in that polymerized unit. The equivalent value of a polymerized unit from an anionic monomer is the number of anions that are covalently bound to the polymer molecule in that polymerized unit. Thus, the equivalent ratio of polymerized units from all cationic monomers to polymerized units from all anionic monomers is the same as the mole ratio of all cations in polymerized units of cationic monomers to all anions in polymerized units of anionic monomers.

In some ampholytic polymers of the present invention, every polymerized unit from a cationic monomer has an equivalent value of 1. Independently, in some ampholytic polymers of the present invention, at least one polymerized unit from an anionic monomer has an equivalent value of 1. Independently, in some ampholytic polymers of the present invention, at least one polymerized unit from an anionic monomer has an equivalent value of 2. Independently, in some ampholytic polymers of the present invention, at least one polymerized unit from an anionic monomer has an equivalent value of 1 and at least one polymerized unit from an anionic monomer has an equivalent value of 2.

It is contemplated that the equivalent ratio of an ampholytic polymer of the present invention will be evaluated at "fully ionic" pH conditions, which are defined herein as pH conditions under which substantially all of the cations covalently bound to the ampholytic polymer are in cationic form (rather than in neutral form) and under which substantially all of the anions covalently bound to the ampholytic polymer are in anionic form (rather than in neutral form). In some embodiments, one or more ampholytic polymers of the present invention will be in fully ionic pH conditions at pH values that are useful for performing laundry operations. In some embodiments, one or more ampholytic polymers of the present invention will be in fully ionic pH conditions at pH values that are useful for washing fabric. Independently, in some embodiments, one or more ampholytic polymers of the present invention will be in fully ionic pH conditions at pH values of 6 or higher; or 7 or higher; or 7.5 or higher. Independently, in some embodiments, one or more ampholytic polymers of the present invention will be in fully ionic pH conditions at pH values of 11 or lower; or 10.5 or lower.

In some embodiments, the equivalent ratio of polymerized units from all cationic monomers to polymerized units from all anionic monomers is from 0.33:1 or higher. In some embodiments, that equivalent ratio is 0.5:1 or higher; or 0.75:1 or higher; or 0.9:1 or higher; or 0.95 or higher.

Independently, in some embodiments, the equivalent ratio of polymerized units from all cationic monomers to polymerized units from all anionic monomers is 1.2:1 or lower. In some embodiments, that equivalent ratio is 1.1:1 or lower; or 1.05:1 or lower.

In some embodiments, the ampholytic polymer of the present invention has weight-average molecular weight of 50,000 or less. In some embodiments, the ampholytic polymer of the present invention has weight-average molecular weight of 40,000 or less; or 30,000 or less; or 20,000 or less.

Independently, in some embodiments, the ampholytic polymer of the present invention has weight-average molecular weight of 1,000 or more. In some embodiments, the ampholytic polymer of the present invention has weight-average molecular weight of 2,000 or more; or 3,000 or more; or 5,000 or more.

The amount of ampholytic polymer in the laundry composition of the present invention is 0.05% or more, by solids weight percent, based on the solids weight of the laundry composition. In some embodiments, the laundry composition of the present invention contains ampholytic polymer in the amount, by solids weight percent, based on the solids weight of the laundry composition, of 0.1% or more; or 0.2% or more; or 0.5% or more; or 0.8% or more. In some embodiments, the laundry composition of the present invention contains ampholytic polymer in the amount, by solids weight percent, based on the solids weight of the laundry composition, of 25% or less; or 10% or less; or 5% or less; or 3% or less.

The ampholytic polymer of the present invention may be made by any polymerization method, including, for example, solution polymerization, bulk polymerization, heterogeneous phase polymerization (including, for example, emulsion polymerization, suspension polymerization, dispersion polymerization, and reverse-emulsion polymerization), and combinations thereof. Independently, the ampholytic polymer of the present invention may be made with any type of polymerization reaction, including, for example, free radical polymerization. When solution polymerization is used, the solvent may be an aqueous solvent (i.e., the solvent is 75% or more water, by weight, based on the weight of the solvent) or an organic solvent (i.e., a solvent that is not aqueous). In some embodiments, at least one ampholytic polymer is made by free radical solution polymerization in solution. Among such embodiments, at least one ampholytic polymer is made by free radical solution polymerization in an aqueous solvent.

Independent of the methods and reactions used to make the ampholytic polymer of the present invention, various suitable ampholytic polymers are soluble or dispersible in various media. A polymer is said herein to be "soluble" in a particular solvent if that polymer can be dissolved in that solvent in an amount of 5% or more by weight of polymer, based on the weight of solvent. In some embodiments, at least one ampholytic polymer is used that is soluble or dispersible in an organic solvent. In some embodiments, at least one ampholytic polymer is used that is soluble or dispersible in an aqueous solvent. In some embodiments, at least one ampholytic polymer is used that is soluble in an aqueous solvent. In some embodiments, at least one ampholytic polymer is used that is soluble in an aqueous solvent in the amount, by weight of polymer, based on the weight of aqueous solvent, of 10% or more; or 20% or more; or 30% or more.

In some embodiments, the laundry composition of the present invention includes at least one ampholytic polymer and at least one anionic surfactant. Independently, in some embodiments, the laundry composition of the present invention includes at least one ampholytic polymer and at least one cationic surfactant. Independently, in some embodiments, the laundry composition of the present invention includes at least one ampholytic polymer and at least one softening agent. Independently, in some embodiments, the laundry composition of the present invention includes at least one ampholytic polymer, at least one anionic surfactant, and at least one softening agent.

The laundry composition of the present invention may have any form. In some embodiments, the laundry composition is a powder. In some embodiments, the laundry composition is a liquid. In some embodiments, the laundry composition is a mixture of a liquid and at least one powder; in some of such embodiments, the mixture is in the form of a suspension or dispersion.

In the practice of the present invention, the laundry composition may be used to treat fabric during any laundry operation or any combination of laundry operations. For example, the laundry composition of the present invention may be used to treat fabric during a washing or rinsing or drying or any combination thereof. In some embodiments, the laundry composition of the present invention is used during washing of fabric.

It is sometimes desired to provide dual function laundry compositions, which are compositions that are capable of both effective cleaning and effective softening. One useful method for assessing the cleaning effectiveness of a laundry composition is testing the ability of that laundry composition to resist clay-soil redeposition, and that resistance to clay-soil redeposition can be measured by the redeposition test described herein below in the Examples section. One method of measuring the softening effectiveness of a laundry composition of interest is to launder fabric in the laundry composition of interest and have a group of people handle the fabric and rate its softness. Alternatively, another useful method of assessment of the softening effectiveness is the amount of softening agent that can be contained in the laundry composition and effectively delivered to fabric. It is contemplated that, when the laundry composition is a liquid, and if all the ingredients, including the softening agent, remain in solution without phase separating, then the softening agent will be effectively delivered to fabric.

Some embodiments of the present invention involve laundry compositions that include at least one ampholytic polymer, at least one anionic surfactant, and at least one softening agent. Some of such embodiments perform well as dual function laundry compositions.

In some embodiments, the laundry composition of the present invention contains one or more laundry adjuvants. Laundry adjuvants are materials other than surfactants and softening agents that improve the laundry process. Laundry adjuvants include, for example, hydrotropes, builders, cellulose derivatives, acrylic acid polymers, enzymes, enzyme stabilizing agents, fluorescent whitening agents, bleaching agents, and mixtures thereof.

Among embodiments in which one or more hydrotropes are used, suitable hydrotropes include, for example, alcohols, glycols, alkanolamines, aryl sulfonates, and mixtures thereof. Suitable alcohols include, for example, ethanol, isopropyl alcohol, and mixtures thereof. Suitable glycols include, for example, propylene glycol. Suitable alkanolamines include, for example, monoethanolamine, ethanolamine, triethanolamine, and mixtures thereof. Suitable aryl sulfonates include, for example, ammonium xylene sulfonate, sodium xylene sulfonate, potassium xylene sulfonates, sodium methyl naphthalene sulfonate, sodium cumene sulfonate, sodium toluene sulfonate, and mixtures thereof.

Builders are materials that remove hardness ions from the water used in the laundry process. In embodiments in which one or more builders are used, suitable builders include, for example, phosphates, carbonates, silicates, zeolites, sequestering agents, neutral soluble salts, and mixtures thereof. Suitable phosphates include, for example sodium tripolyphosphate, tetrasodium pyrophosphate, trisodium orthophosphate, tetrapotassium pyrophosphate, other phosphates, and mixtures thereof. Suitable carbonates include, for example, sodium carbonate, sodium bicarbonate, sodium sesquicarbonate, and mixtures thereof. Suitable silicates include, for example, sodium silicates, such as, for example, sodium silicates with a ratio of $SiO_2$ to $Na_2O$ of higher than 1:1, for example those with such a ratio of 2.0:1 to 2.4:1. Type A zeolites are examples of suitable zeolites. Suitable sequestering agents include, for example, nitrilotriacetic acid, ethylenediaminetetraacetic acid, organic phosphates, sodium tartrate monosuccinate, sodium tartrate disuccinate, and mixtures thereof. Suitable neutral soluble salts include, for example, sodium sulfate.

Cellulose derivatives are believed to contribute to prevention of redeposition of soil during the laundry process. Among embodiments in which one or more cellulose derivatives are used, suitable cellulose derivatives include, for example, sodium carboxymethylcellulose, methylcellulose, hydroxyalkylcellulose, and mixtures thereof.

Among embodiments in which one or more acrylic acid polymers are used, suitable acrylic acid polymers include homopolymers of acrylic acid, copolymers of acrylic acid with other monomers, and mixtures thereof. Independently, among embodiments in which one or more acrylic acid polymers are used, suitable acrylic acid polymers include, for example, acrylic acid polymers with weight-average molecular weight below 70,000, or acrylic acid polymers with weight-average molecular weight below 10,000. Independently, among embodiments in which one or more acrylic acid polymers are used, some of such embodiments also include one or more cellulose derivatives.

Among embodiments in which one or more enzymes are used, suitable enzymes include, for example, proteases, amylases, lipases, cellulases, peroxidases, and mixtures thereof.

Among embodiments in which one or more bleaching agents are used, suitable bleaching agents include, for example, sodium percarbonate, sodium perborate tetrahydrate, sodium perborate monohydrate, and mixtures thereof.

In the past, some previously-known laundry compositions included, among other ingredients, an anionic surfactant and an acrylic acid polymer; it is contemplated that some embodiments of the present invention would be laundry compositions similar to such previously-known laundry compositions, in which some or all of the acrylic acid polymer was replaced by one or more ampholytic polymer of the present invention. It is contemplated that such embodiments of the present invention would have improved inhibition of clay soil redeposition when compared to comparable previously-known laundry compositions. It is contemplated that the improvement would either be an actual reduction of clay soil redeposition or else a similar inhibition of clay soil redeposition achieved by a laundry composition made with a smaller amount of polymeric ingredients.

EXAMPLES

Abbreviations

AA=acrylic acid
APTAC=acrylamidopropyltrimethylammonium chloride
DADMAC=diallyldimethylammonium chloride
Am=acrylamide Redeposition Test Terry cloth squares (from Test Fabrics Co.) 10.2 cm by 10.2 cm (4 inch by 4 inch) were stripped by washing 3 times in a detergent base that is free of dyes and fragrances. The terry cloth squares were then laundered in a Terg-o-Tometer (from United States Testing Co.) using tap water (80 ppm of total hardness, with 2:1 ratio of $Ca^{++}$ to $Mg^{++}$). Each load contained 2 terry cloth squares, 1.0 liter of water, 2.0 g of the laundry product to be tested per liter of water, and 1 g of a slurry containing 20% clay. The laundry process was a 12 minute wash at 35° C., a 3 minute rinse with cold water, and tumble drying. After the laundry process, the whiteness index of each terry cloth square was measured with a Pacific Scientific calorimeter. The whiteness index (WI) is calculated from the measured standard tristimulus values Y and Z as follows: WI=3.387*Z−3*Y. This method of calculating WI is known as Taube's whiteness equation and is described, for example, in section X2.2.3 of a publication by ASTM International, "ASTM E 313-00." Higher whiteness index demonstrates greater ability of the laundry product to resist the deposition of clay onto the cloth.

Turbidity

The turbidity of liquid formulations was measured with an instrument manufactured by HF Instruments, model DRT 100D. Results are reported as NTU (nephelometric turbidity units). Deionized water has turbidity of 0.0 NTU. Lower turbidity (i.e., lower NTU values) means improved compatibility of the ingredients.

Detergent Base DB1:

A formulation known herein as "DB1" was formulated as follows:

| parts(1) | ingredient |
|---|---|
| 17.78 | Witconate ™ 90 Flakes(2) |
| 6.9 | Witcolate ™ LES-60C surfactant(3) |
| 10 | Neodol ™ 23-6.5 surfactant(4) |
| 5 | sodium citrate dihydrate |
| 5 | propylene glycol |
| 2 | ethanol |
| 6.25 | sodium xylene sulfonate(5) |
| 46.77 | water |

(1)by weight of ingredient as supplied, based on the total weight of DB1.
(2)linear alkyl benzene sulfonate, manufactured by Witco Corp., supplied as 90% active ingredient in water.
(3)sodium alcohol ethoxylate sulfate, manufactured by Witco Corp., supplied as 58% active ingredient in water.
(4)alcohol ethoxylate, manufactured by Shell Chemical, based on C12-C13 NEODOL ™ alcohol with an average of approximately 6.5 moles of ethylene oxide per mole of alcohol.
(5)Stepanate ™ XSX, manufactured by Stepan Corp., supplied as 40% active ingredient in water.

Example 1

Preparation of an Ampholytic Polymer

A one liter resin kettle with overhead stirrer, condenser, thermocouple, heating mantle, and inlets for the addition of monomers, initiator and chain regulator was set up in an exhaust hood. 100 grams of deionized water and 3.96 grams of a 0.15% ferrous sulfate solution was charged to the kettle and heated to 78° C. Monomer Solution #1 was prepared by charging 153.84 grams of diallyldimethylammonium chloride (65 weight % in water) to a graduated cylinder. Monomer Solution #2 was prepared by charging 45 grams of acrylic acid and 103.7 grams of 53% acrylamide to a graduated cylinder. An initiator solution of 1.4 grams of sodium persulfate and 20 grams of deionized water was prepared. A kettle additive of 0.5 grams of sodium metabisulfite and 5 grams of deionized water was prepared. A chain regulator solution was prepared by mixing 11 grams of sodium metabisulfite and 35 grams of deionized water. When the reactor reached 78° C., the kettle additive was charged and the feeds were begun simultaneously. Monomer Solution #1 and the chain regulator solutions were added over 90 minutes. Monomer Solution #2 was added over 105 minutes and the initiator solution was added over 110 minutes. At the completion of all the cofeeds, the reaction was held for 15 minutes at 78° C. The chaser solutions were then prepared, as follows. 1.35 grams of 70% tert-butyl hydroperoxide and 10 grams of deionized water was prepared. 0.92 grams isoascorbic acid and 10 grams of deionized water was prepared. 6 grams of acrylic acid and 4 grams of deionized water were mixed. At the completion of the hold, the kettle was cooled to 75° C. and the AA/water solution was charged to the flask. The remaining chasers were then added over 30 minutes at 75° C. At the completion of the chase feeds, the reaction was held for 30 minutes. At the end of the 30 minutes, the reaction was then cooled and packaged. Final solids of the reaction was 43.6%, pH was 2.6 and molecular weight was 12380.

Example 2

Preparation of Additional Ampholytic Polymers

Using the methods described in Example 1 herein above, various ampholytic polymers were made by adjusting the amounts and compositions of Monomer Solution #1 and Monomer Solution #2 to achieve the following weight ratios (of actual monomers, regardless of the water that may have been used to dissolve any of the monomers) in each polymer. "M.W." is weight-average molecular weight, as determined by Size Exclusion Chromatography.

| Polymer | Weight Ratio | Monomers | M.W. |
|---|---|---|---|
| P1 | 75/25 | AA/APTAC | 1,500 |
| P2 | 50/50 | AA/APTAC | 12,690 |
| P3 | 24/76 | AA/APTAC | 1,100 |
| P4 | 31/69 | AA/DADMAC | 21,600 |
| P5 | 31/69 | AA/DADMAC | 36,070 |
| P6 | 31/69 | AA/DADMAC | 34,400 |
| P7 | 31/69 | AA/DADMAC | 19,520 |
| P8 | 22.5/27.5/50.0 | AA/Am/DADMAC | 12,250[21] |
| P9 | 19.2/37.7/43.1 | AA/Am/DADMAC | 8,140[21] |

[21]average of two measurements

Example 3

Results of Redeposition Testing

The following formulas were made and tested by the redeposition test described herein above, with the following results:

| Formula No. | DB1 (pbw[7]) | Polyquat[6] (pbw[8]) | polymer added | polymer (pbw[9]) | Whiteness Index |
|---|---|---|---|---|---|
| CF31[10] | 99.7 | 0.3 | none | 0 | 31.0 |
| F32 | 99.2 | 0.3 | P1 | 0.5 | 35.5 |
| F33 | 99.2 | 0.3 | P2 | 0.5 | 34.9 |
| F34 | 99.2 | 0.3 | P3 | 0.5 | 47.6 |
| F35 | 99.2 | 0.3 | P4 | 0.5 | 43.1 |

[6]UCARE ™ polymer JR 400, polyquaternium-10, manufactured by Dow Chemical Co.
[7]parts by total weight of DB1, as described herein above.
[8]parts by solid weight of polyquat material.
[9]parts by solid weight of ampholytic polymer
[10]comparative formulation Formulations with ampholytic polymer show higher whiteness index, which indicates better resistance to redeposition of clay soil.

Example 4

Results of Further Redeposition Testing

The following formulas were made and tested by the redeposition test described herein above, with the following results (notes (6)-(10) are defined in Example 3 herein above):

| Formula No. | DB1 (pbw[7]) | Polyquat[6] (pbw[8]) | polymer added | polymer (pbw[9]) | Whiteness Index |
|---|---|---|---|---|---|
| CF41[10] | 99.2 | 0.3 | CPA[11] | 0.5 | 42.0 |
| CF42[10] | 99.2 | 0.3 | CPB[12] | 0.5 | 44.3 |
| F43 | 99.2 | 0.3 | P5 | 0.5 | 47.3 |
| F44 | 99.2 | 0.3 | P4 | 0.5 | 48.4 |
| CF45[10] | 99.7 | 0.3 | none | 0 | 39.5 |

[11]Comparative Polymer A, Acusol ™ 445N dispersant, poly(AA), manufactured by Rohm and Haas Company.
[12]Comparative Polymer A, Acusol ™ 460N dispersant, maleic/olefin copolymer, manufactured by Rohm and Haas Company.

Formulations with ampholytic polymer show higher whiteness index, which indicates better resistance to redeposition of clay soil.

Example 5

Results of Additional Redeposition Testing

The following formulas were made and tested by the redeposition test described herein above, with the following results (notes (6)-(10) are defined in Example 3 herein above):

| Formula No. | DB1 (pbw[7]) | Polyquat[6] (pbw[8]) | polymer added | polymer (pbw[9]) | Whiteness Index |
|---|---|---|---|---|---|
| CF51[10] | 99.7 | 0.3 | none | 0 | 48.8 |
| CF52[10] | 99.2 | 0.3 | CPC[13] | 0.5 | 41.4 |
| CF53[10] | 99.2 | 0.3 | CPD[14] | 0.5 | 39.1 |
| F54 | 99.2 | 0.3 | P6 | 0.5 | 54.0 |
| F55 | 99.2 | 0.3 | P4 | 0.5 | 55.4 |

[13]Comparative Polymer C, Floquat ™ PRP 4440 DADMAC homopolymer, manufactured by SNF Floeger Company.
[14]Comparative Polymer D, Floquat ™ PRP 4820 DADMAC homopolymer, manufactured by SNF Floeger Company, disclosed by the manufacturer to have higher molecular weight than Floquat ™ PRP 4440 DADMAC homopolymer.

Formulations with ampholytic polymer show higher whiteness index, which indicates better resistance to redeposition of clay soil.

Example 6

Results of More Redeposition Testing and of Turbidity Testing

The following formulas were made and tested by the redeposition and turbidity tests described herein above, with the following results (notes (6)-(11) are defined in Examples 3-4 herein above):

| Formula No. | DB1 (pbw[7]) | Poly-quat[6] (pbw[8]) | polymer added | polymer (pbw[9]) | Whiteness Index | Turbidity (NTU) |
|---|---|---|---|---|---|---|
| CF61[10] | 99.7 | 0.3 | none | 0 | 35.2 | 2.4 |
| CF62[10] | 99.2 | 0.3 | CPA[11] | 0.5 | 39.2 | 206 |
| F63 | 99.2 | 0.3 | P1 | 0.5 | NT[15] | 61.9 |
| F64 | 99.2 | 0.3 | P2 | 0.5 | NT[15] | 3.4 |
| F65 | 99.2 | 0.3 | P3 | 0.5 | 57.0 | 3.2 |
| F66 | 99.2 | 0.3 | P7 | 0.5 | 57.8 | 3.8 |
| F67 | 99.2 | 0.3 | P8 | 0.5 | 58.8 | 3.8 |
| F68 | 99.2 | 0.3 | P9 | 0.5 | 59.0 | 7.0 |

[15]not tested in Example 6. Whiteness index for similar formulations is reported herein above in Example 3.

The formulations containing ampholytic polymer had good turbidity results and good whiteness index.

We claim:

1. A laundry composition comprising i) at least one laundry component comprising one or more anionic surfactant and one or more softening agent, wherein said softening agent comprises one or more cationic surfactant or one or more blend of an anionic surfactant with a water-soluble cationic polymer or a mixture thereof, and ii) at least one ampholytic polymer comprising, as polymerized units, a) 20% to 90% by weight, based on the solid weight of said ampholytic polymer, at least one cationic monomer, b) 10% to 70% by weight, based on the solid weight of said ampholytic polymer, at least one anionic monomer, and c) 0% to 90% by weight, based on the solid weight of said ampholytic polymer, at least one nonionic monomer;

wherein the equivalent ratio of said monomer a) to said monomer b) is from 0.5:1 to 1.2:1; and wherein said ampholytic polymer has weight-average molecular weight of 50,000 or less.

2. The laundry composition of claim 1, wherein said laundry composition further comprises at least one ingredient selected from the group consisting of hydrotropes, builders, cellulose derivatives, enzymes, enzyme stabilizing agents, whitening agents, bleaching agents, and mixtures thereof.

3. The laundry composition of claim 1, wherein said cationic monomer is selected from the group consisting of diallyldialkylammonium quaternary compounds, acrylamidoalkyltrialkylammonim quaternary compounds, methacrylamidoalkyltrialkylammonim quaternary compounds, and mixtures thereof.

4. The laundry composition of claim 1, wherein said anionic monomer is selected from the group consisting of carboxylic acid monomers, sulfonic acid monomers, and mixtures thereof.

5. The laundry composition of claim 1, wherein said polymer comprises no polymerized units of crosslinking monomer.

6. The laundry composition of claim 1, wherein said polymer comprises no polymerized units of C4 or higher alkyl esters of acrylic acid or methacrylic acid.

7. The laundry composition of claim 1, wherein said polymer comprises no polymerized units of alkyl esters of acrylic acid or methacrylic acid where the ester group contains any alkylene oxide group.

8. A method of laundering textiles comprising treating said textiles with the laundry composition of claim 1.

* * * * *